US008210958B2

(12) United States Patent
Prater

(10) Patent No.: US 8,210,958 B2
(45) Date of Patent: Jul. 3, 2012

(54) GOLF SWING TRAINER

(75) Inventor: Christopher K. Prater, Salt Point, NY (US)

(73) Assignee: James Murray, Bronxville, NY (US)

( * ) Notice: Subject to any disclaimer, the term of this patent is extended or adjusted under 35 U.S.C. 154(b) by 14 days.

(21) Appl. No.: 12/976,037

(22) Filed: Dec. 22, 2010

(65) Prior Publication Data

US 2011/0151984 A1 Jun. 23, 2011

Related U.S. Application Data

(60) Provisional application No. 61/289,715, filed on Dec. 23, 2009.

(51) Int. Cl.
*A63B 69/36* (2006.01)

(52) U.S. Cl. ..... 473/145; 473/143; 473/140

(58) Field of Classification Search ..... 473/139, 473/140, 143, 145, 147, 422, 423, 429, 430, 473/219, 221, 409
See application file for complete search history.

(56) References Cited

U.S. PATENT DOCUMENTS

| | | | | |
|---|---|---|---|---|
| 1,967,776 | A * | 7/1934 | Merritt | 473/143 |
| 3,656,759 | A * | 4/1972 | Hall | 473/143 |
| 4,123,053 | A * | 10/1978 | Piccini | 473/451 |
| 5,577,964 | A * | 11/1996 | Chen | 473/145 |
| 5,605,326 | A * | 2/1997 | Spear, Jr. | 473/422 |
| 5,833,555 | A * | 11/1998 | Jer-Min | 473/429 |
| 5,865,683 | A * | 2/1999 | Yang | 473/147 |
| 6,974,389 | B1 * | 12/2005 | Shioda | 473/147 |
| 7,214,136 | B1 * | 5/2007 | Perry et al. | 473/139 |
| 7,691,003 | B2 * | 4/2010 | Munshi | 473/151 |
| 7,704,153 | B2 * | 4/2010 | Loh et al. | 473/221 |
| 2004/0063509 | A1 * | 4/2004 | Shioda | 473/139 |
| 2011/0151984 | A1 * | 6/2011 | Prater | 473/143 |

* cited by examiner

*Primary Examiner* — Raleigh W. Chiu
(74) *Attorney, Agent, or Firm* — Kirschstein, et al.

(57) ABSTRACT

A golf practice and exercise device has an elevated arm from which an impact object is suspended for swinging movement. The object is positioned with a clubhead impact target in position for striking by the clubhead of a golf club swung by a golfer. The resistance to the impact of the golf club is adjustable. A sensor detects the magnitude and velocity of the striking force, and a display displays an indication as to how far a golf ball would have gone after being struck with a force and velocity of the detected magnitude.

18 Claims, 4 Drawing Sheets

GOLF SWING TRAINER

This application claims priority to U.S. Provisional Patent Application Ser. No. 61/289,715, filed Dec. 23, 2009.

BACKGROUND OF THE INVENTION

This invention generally relates to golf swing training devices that improve a golfer's swing and train the golfer's muscles used in the golf swing.

The art has proposed many devices for golfers to practice to improve their swing. For example, a golfer may swing and strike a golf ball-sized object suspended from a flexible tether from one type of device, thereby allowing the golfer to practice and improve his or her technique in a confined space without having to use a driving range. However, the object being struck is the size and weight of a golf ball and, therefore, provides little muscle-building resistance.

Another type of practice device is a relatively large bag, known as an impact bag, that is filled with soft material, such as towels, and is placed against a stationary object, which resists movement of the bag. Such a device stops the practice swing at the point of impact so that the golfer can evaluate the club's and his or her body's positions at impact. The impact bag does not allow the golfer to complete a follow-through of the golf swing and/or to perform a muscle-building exercise by overcoming weight resistance as the club moves through impact into the follow-through.

The art has proposed in U.S. Pat. No. 6,974,389 a device that combines the swing practicing technique with muscle-building exercise. As advantageous as such a combined device is, however, the weight resistance is fixed. There is no adjustment of the weight resistance, or any accommodation to golfers of different ages and muscle strengths, or any feedback as to how hard the object or bag has been struck.

SUMMARY OF THE INVENTION

One aspect of this invention is directed to a golf practice and exercise device that includes an upright support for supporting the device on a floor or on the ground. The upright support has stakes that are staked directly into the ground, or that are received with a friction-fit in a base that rests on the floor. The upright support also has an outwardly extending elevated mounting arm from which an impact object is swingably suspended in position for striking by a golf clubhead during a normal practice golf swing. The impact object has a golf clubhead impact or target surface that presents a sufficiently large target so that a golfer can swing freely without having to closely concentrate on striking a small target, such as a golf ball. The impact object also has a mass sufficient not only to provide resistance to the impact of a golf club to impose muscular strain on the golfer for muscle development, but also to allow the golf clubhead to swing the object sufficiently for the golf clubhead to ultimately pass under the object and allow the golfer to complete a follow-through of the golf swing.

This invention enables the resistance to the impact of the golf club to be adjusted. In one embodiment, a tensioned spring exerts a spring force on the object, and the spring force is adjusted by manually turning a knob, thereby changing the impact resistance. In another embodiment, a taut elastic strap is mounted between the upright support and the object, and the strap exerts a restraining force on the object. Multiple elastic straps of different elasticity are provided, and the user selects the strap having the desired elasticity, thereby changing the impact resistance. A sensor, such as a velocimeter, is also provided in the object for detecting the magnitude and velocity of the striking force, and for outputting an electrical signal to a display for displaying an indication as to how far a golf ball would have gone after being struck with a force and velocity of the detected magnitude. Thus, the device of the present invention provides for practicing the technique of the golf swing, as well as provides progressive muscle development to develop and improve the striking force exerted by the golfer when striking a golf ball. Golfers of different ages and muscle strengths are accommodated by adjusting the spring or restraining force exerted on the object. The display and the sensor provide feedback as to how hard the object has been struck.

The novel features which are considered as characteristic of the invention are set forth in particular in the appended claims. The invention itself, however, both as to its construction and its method of operation, together with additional objects and advantages thereof, will be best understood from the following description of specific embodiments when read in connection with the accompanying drawings.

DETAILED DESCRIPTION OF THE PREFERRED EMBODIMENTS

Figure 1:
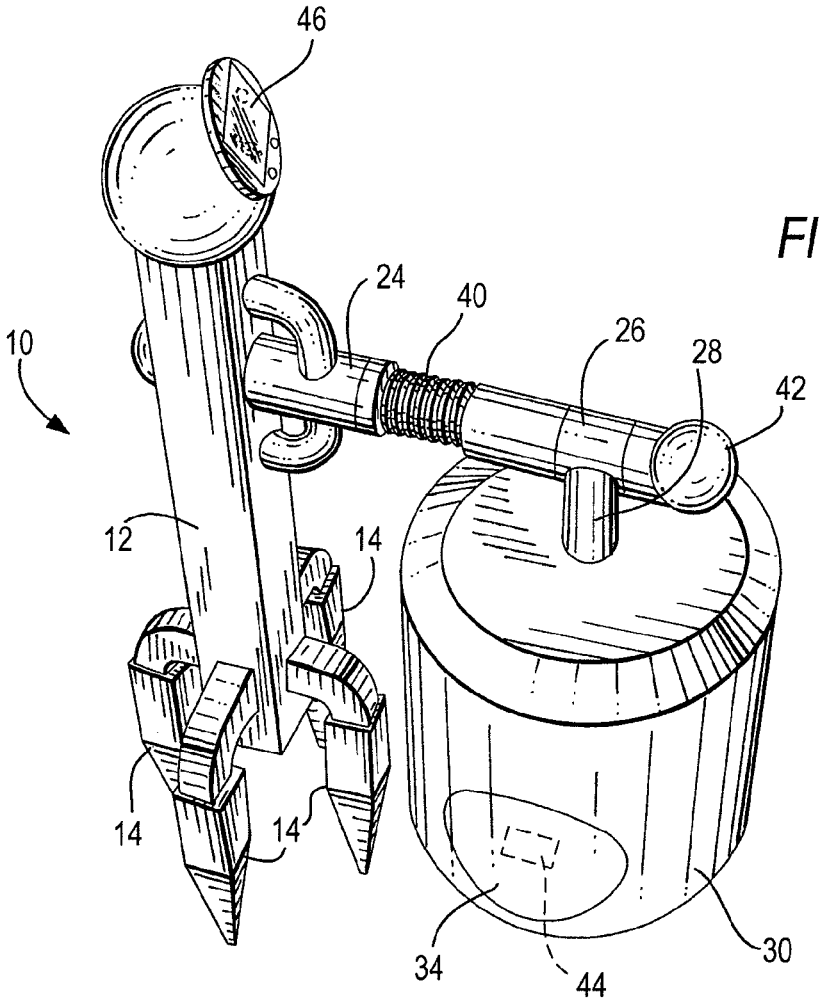
FIG. 1 is a perspective, overhead view of a golf practice and exercise device according to one embodiment of the present invention.
Figure 2:
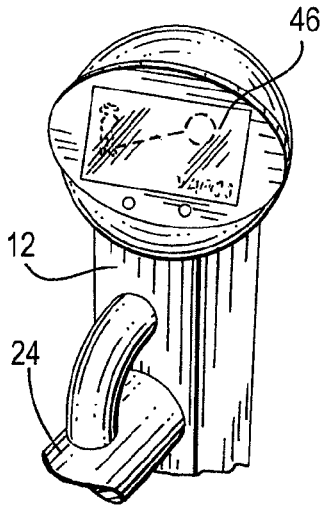
FIG. 2 is an enlarged view of a detail of the embodiment of FIG. 1 illustrating a readout display.

Referring now to the drawings, reference numeral 10 generally identifies one embodiment of a golf practice and exercise device of the present invention. The device 10 includes a vertically upright support 12 having a plurality of lower stakes 14 having pointed ends for staking into the ground 16 (see FIG. 3), or for being received in compartments with a friction-fit in a base 18 that rests on the floor 20 (see FIG. 4). The base 18 is advantageously hollow and constituted of a blow-molded plastic material, and may be weighted down in use by being filled with water or sand. The base may also be equipped with suction feet 22. The upright support 12 is thus held stationary during use.

Figure 3:
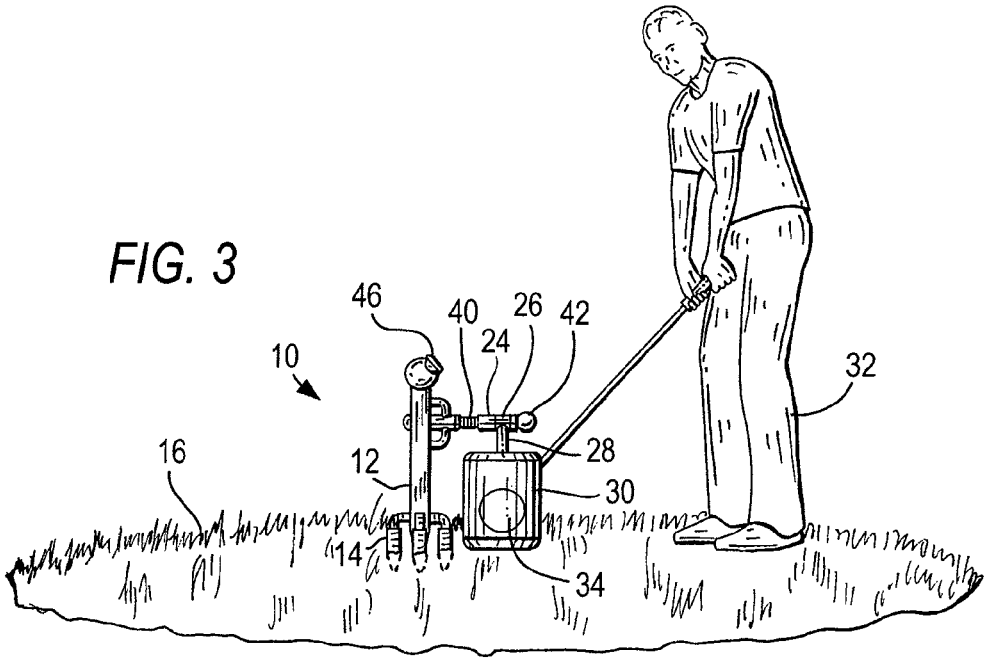
FIG. 3 is a front view of the embodiment of FIG. 1 mounted in an outdoor location, and illustrating a golfer taking a practice swing.
Figure 4:
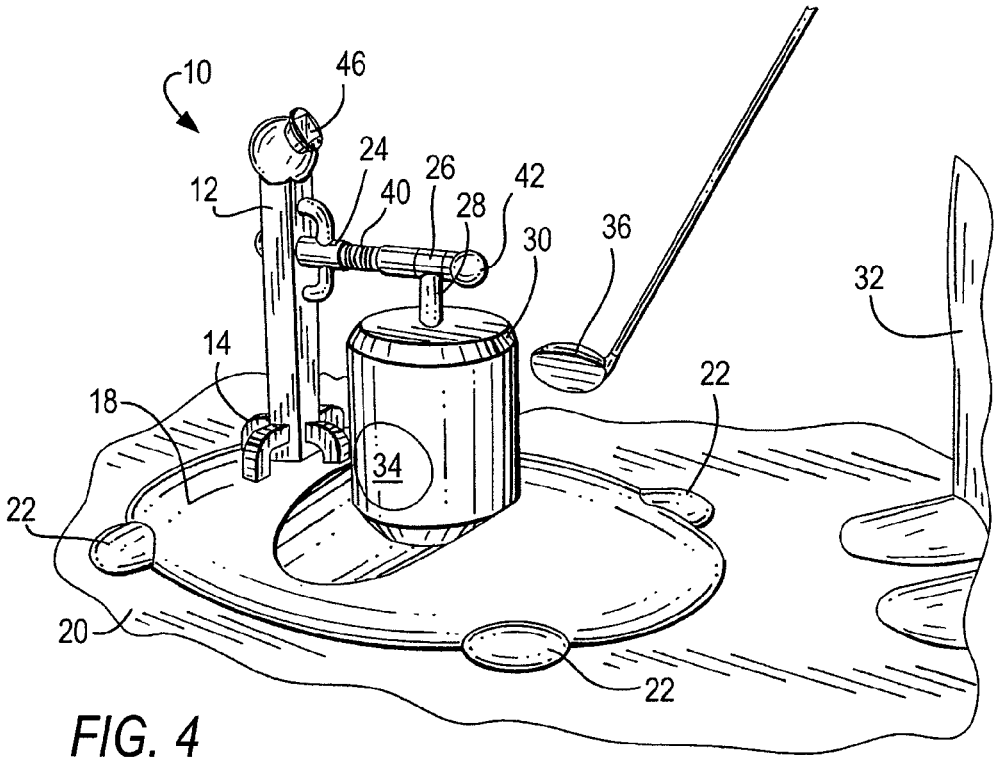
FIG. 4 is a view similar to FIG. 3, but mounted in an indoor location, and again illustrating a golfer taking a practice swing.

An elevated mounting arm 24 projects horizontally outwardly away from the upright support 12. At the outer end region of the mounting arm 24, an impact object 30 to be struck by a golfer 32 is suspended by an annular collar 26 that is rotatably mounted on the arm 24. A rigid tube 28 extends between the collar 26 and the object 30. The object 30 is preferably a cylindrically shaped bag that has a golf clubhead impact target 34 provided on both opposite sides of the object 30 on its outer surface in a position, as shown in FIGS. 3-4, for striking by a golf clubhead 36 swung by a golfer 32. The bag or object 30 is advantageously a leather pouch filled with a lightweight foam material. The size of the golf clubhead impact target 34 is sufficiently large so that the golfer 32 can swing freely without having to closely concentrate on striking a small target, as is the prior art case of swinging at a golf ball.

When the golfer 32 uses the device 10, he or she positions himself or herself in an address position, as shown in FIG. 3, with the clubhead 36 of the club at or contacting the striking impact target 34 of the object 30. The golfer 32 then takes a normal back swing and then a down swing with the clubhead 36 striking the impact target 34 of the object 30. Because of the size of the impact target 34 of the object 30, the golfer 32 need not be concerned or concentrate on the specific location of the clubhead 36 at the striking target 34 as he or she is when practicing with a golf ball.

Also, due to the mass of the object 30, the golfer 32 will swing hard at the object 30, and considerably harder than the golfer 32 would normally think about when striking a small light golf ball. This action facilitates the golfer 32 utilizing his or her body to provide maximum force, which results in the golfer obtaining a proper body turn and positioning at the point of impact. This not only trains the golfer to arrive at a proper ball striking position, but places the golfer in position for continuing through the swing against the weight or resistance of the object 30, thereby providing for practicing of technique, as well as for building strong muscles that are used in the golf swing. With this arrangement, the object 30 will preferably swing with a pendulum-like oscillation, or may even swing totally around the arm 24, when the object 30 is struck, and the golfer 32 completely follows through on the golf swing.

As described so far, the object 30 imposes a certain muscular strain on the golfer 32 when struck for muscle development. The resistance to the impact of the golf club can be adjusted. As shown for the embodiment of the device 10 depicted in FIGS. 1-4, a coil spring 40 on the arm 24 bears with a spring force against the collar 26. The force of the spring 40 is adjusted by manually turning a knob 42, thereby changing the impact resistance to a desired value. A sensor 44, such as a velocimeter, is provided within the object 30 (see FIG. 1) for detecting the magnitude and velocity of the striking force, and for outputting an electrical signal to a display 46 for displaying an indication as to how far a golf ball would have gone after being struck with a force and velocity of the detected magnitude. The display 46 is preferably an LCD display located at the top of the upright support 12 and is connected by low voltage wires (not illustrated) routed internally through the support 12, the arm 24, and the tube 28 to the sensor 44.

Figure 5:
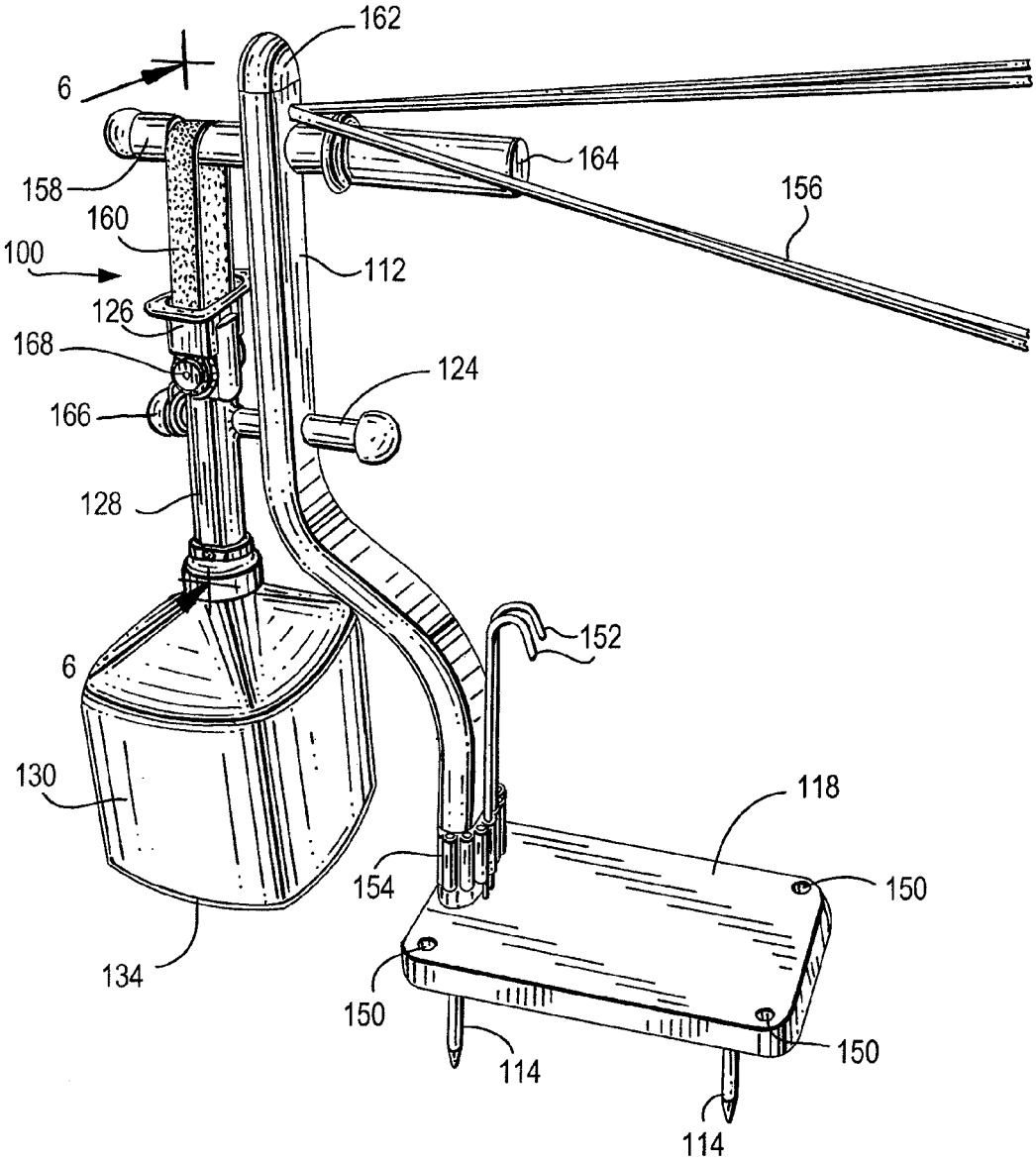
FIG. 5 is a perspective view of another embodiment of a golf practice and exercise device according to the present invention.

Another embodiment of a golf practice and exercise device 100 is depicted in FIG. 5. The device 100 includes an offset, upright support 112 mounted on a base 118 having a plurality of detachable lower stakes 114 having pointed ends for staking into the ground. The base 118 advantageously has additional holes 150 through which additional stakes may be inserted and staked into the ground. For additional support, one portion of a rope 156 is secured to the upright support 112, and an opposite portion of the rope 156 is anchored into the ground by additional stakes 152. The additional stakes 152 are shown in FIG. 5 as being mounted in a storage holder 154 that is, in turn, snap-fitted on the upright support 112. The additional stakes 152 are removed from their holder 154 and anchor the rope 156 into the ground at a distance away from the upright support 112 for additional support. The upright support 112 is thus held stationary during use.

A lower cylindrical elevated mounting arm 124 projects horizontally outwardly away from the upright support 112. An upper cylindrical elevated mounting arm 158 also projects horizontally outwardly away from the upright support 112 and is parallel to the lower mounting arm 124. At the outer end region of the lower mounting arm 124, an impact object 130 to be struck by the golfer 32 is suspended for swinging movement about the lower mounting arm 124. A rigid cylindrical tube 128 extends between a yoke 126 and the object 130. The lower mounting arm 124 extends through a cylindrical passage extending through the rigid tube 128. The passage serves as a bearing around which the tube 128 and the object 130 pivot. A locking cap 166 is detachably mounted on the outer end of the lower mounting arm 124. The object 130 is preferably a box-shaped bag that has a golf clubhead impact target 134 provided on both opposite sides of the object 130 on its outer surface in a position for striking by a golf clubhead 36 swung by the golfer 32. The bag or object 130 is advantageously a leather pouch filled with a lightweight foam material. The size of the golf clubhead impact target 134 is sufficiently large so that the golfer 32 can swing freely without having to closely concentrate on striking a small target, as is the prior art case of swinging at a golf ball.

When the golfer 32 uses the device 100, he or she positions himself or herself in an address position, as shown in FIG. 3, with the clubhead 36 of the club at or contacting the striking impact target 134 of the object 130. The golfer 32 then takes a normal back swing and then a down swing with the clubhead 36 striking the impact target 134 of the object 130. Because of the size of the impact target 134 of the object 130, the golfer 32 need not be concerned or concentrate on the specific location of the clubhead 36 at the striking target 134 as he or she is when practicing with a golf ball.

Also, due to the mass of the object 130, the golfer 32 will swing hard at the object 130, and considerably harder than the golfer 32 would normally think about when striking a small light golf ball. This action facilitates the golfer 32 utilizing his or her body to provide maximum force, which results in the golfer obtaining a proper body turn and positioning at the point of impact. This not only trains the golfer to arrive at a proper ball striking position, but places the golfer in position for continuing through the swing against the resistance of the object 130, thereby providing for practicing of technique, as well as for building strong muscles that are used in the golf swing. With this arrangement, the object 130 will preferably swing with a pendulum-like oscillation on the arm 124, when the object 130 is struck, and the golfer 32 completely follows through on the golf swing.

Figure 6:
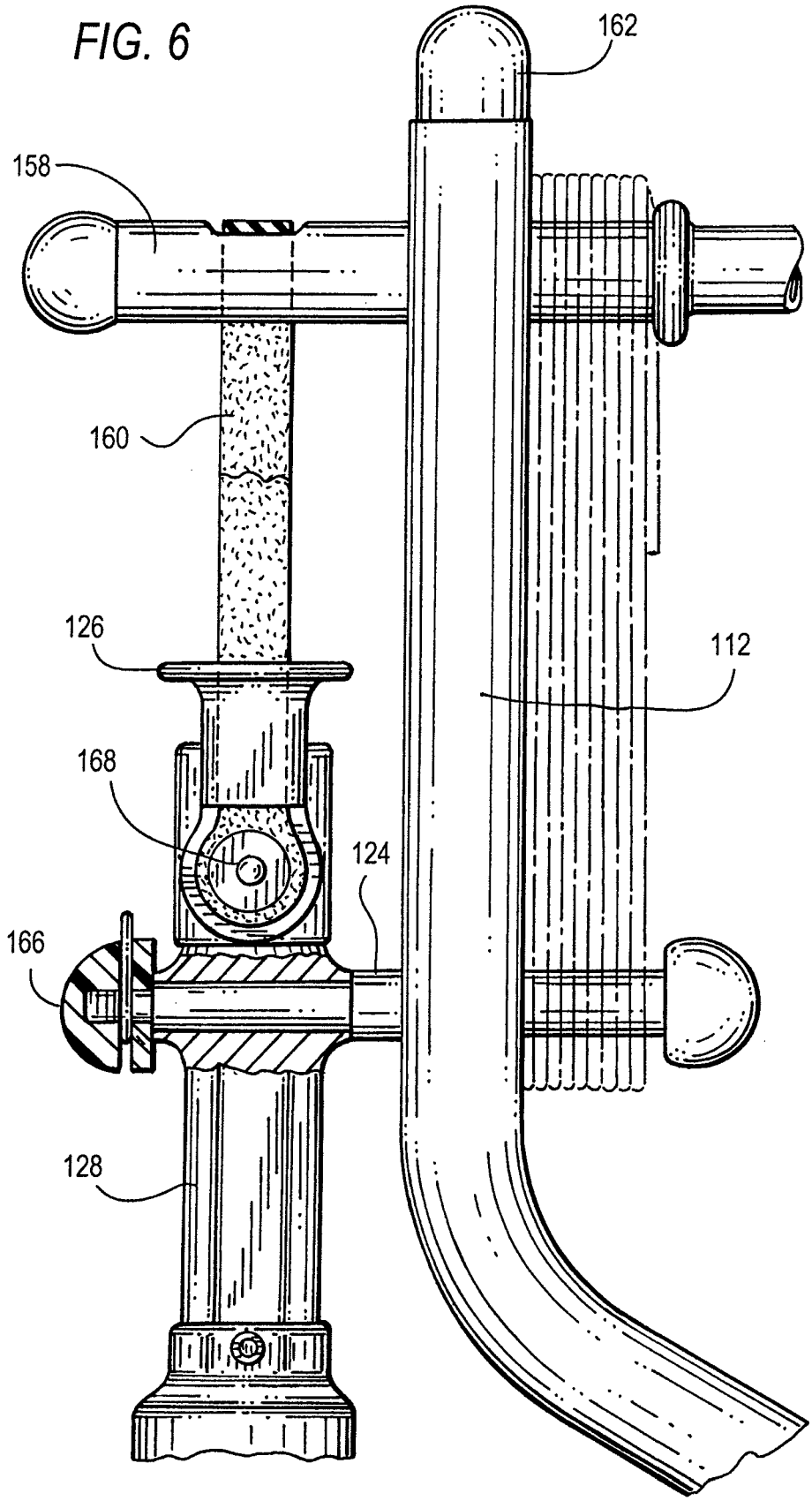
FIG. 6 is a part-sectional, part-elevational view taken on line 6-6 of FIG. 5.

As described above, the resistance to the impact of the golf club can also be adjusted in the embodiment of FIG. 5. The object 130 is restrained by a taut elastic strap 160, preferably made of rubber or a like stretchable material, As shown in FIG. 6, a middle portion of the strap 160 is mounted on and straddles a recessed portion of the upper support arm 158, and the opposite end portions of the strap are routed into the interior of the yoke 126 and connected to opposite sides of the yoke by a threaded fastener 168 that passes through preformed apertures in the opposite end portions of the strap. Multiple elastic straps of different elasticity are provided, and the golfer selects the strap having the desired elasticity. When the object 130 is struck, the tube 128 pivots about the lower support arm 124, but is resisted by the taut strap 160 to the extent determined by its elasticity.

Thus, the device of the present invention provides for practicing the technique of the golf swing, both for right- and left-handed golfers, as well as provides progressive muscle development by changing the force exerted by the tensioned spring or selected taut strap to develop and improve the striking force exerted by the golfer when striking a golf ball. Golfers of different ages and muscle strengths are accommodated by adjusting the force, as is the single golfer who simply wants to more strongly hit a golf ball.

It will be understood that each of the elements described above, or two or more together, also may find a useful application in other types of constructions differing from the types described above.

While the invention has been illustrated and described as embodied in a golf swing trainer, it is not intended to be limited to the details shown, since various modifications and structural changes may be made without departing in any way from the spirit of the present invention. For example, a cap 162 may be removably mounted at the top of the upright support 112 to uncover an internal compartment in which the additional stakes 152 and/or the additional elastic straps may be stored. A grip or handle 164 is advantageously used to lift and transport the device 100. The aforementioned rope 156 can conveniently be wrapped around the two arms 124, 158 for storage.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention and, therefore, such adaptations should and are intended to be comprehended within the meaning and range of equivalence of the following claims.

What is claimed as new and desired to be protected by Letters Patent is set forth in the appended claims.

I claim:

1. A golf swing training device, comprising:

an upright stationary support having an elevated arm extending away from the stationary support;

an impact object suspended from the elevated arm for swinging movement and having a golf clubhead impact surface in position for striking by a golf clubhead during a practice golf swing by a golfer, the impact object having an impact resistance as the clubhead moves through impact during the swing; and an assembly for adjusting the impact resistance prior to the swing to develop and improve a striking force exerted by the golfer.

2. The training device of claim 1, wherein the stationary support includes a plurality of ground stakes staked into the ground.

3. The training device of claim 1, wherein the stationary support includes a base resting on the ground.

4. The training device of claim 1, wherein the stationary support includes a base and a plurality of ground stakes mounted on the base and staked into the ground.

5. The training device of claim 1, wherein the stationary support includes a rope having one portion connected to the stationary support and an opposite portion anchored to the ground by ground stakes.

6. The training device of claim 1, wherein the impact object is one of a cylindrically-shaped bag and a box-shaped bag, and wherein the impact object is filled with a material and has the impact surface on opposite sides of the impact object.

7. The training device of claim 1, and a sensor on the impact object for detecting the striking force, and a display for displaying the striking force exerted by the golfer.

8. The training device of claim 1, wherein the impact resistance adjusting assembly includes a coil spring and a turnable knob for changing tension of the coil spring as the knob is turned.

9. The training device of claim 1, wherein the impact resistance adjusting assembly includes a selected elastic strap from a plurality of elastic straps of different predetermined elasticities.

10. A golf swing training method, comprising the steps of:

stationarily uprightly mounting a support with an elevated arm extending away from the support;

suspending an impact object from the elevated arm for swinging movement;

positioning a golf clubhead impact surface on the impact object in position for striking by a golf clubhead during a practice golf swing by a golfer;

configuring the impact object with an impact resistance as the clubhead moves through impact during the swing; and adjusting the impact resistance prior to the swing to develop and improve a striking force exerted by the golfer.

11. The method of claim 10, wherein the mounting step includes staking a plurality of ground stakes into the ground.

12. The method of claim 10, wherein the mounting step includes resting a base on the ground.

13. The method of claim 10, wherein the mounting step includes resting a base on the ground, and staking a plurality of ground stakes mounted on the base into the ground.

14. The method of claim 10, wherein the mounting step includes connecting one portion of a rope to the support, and anchoring an opposite portion of the rope to the ground with ground stakes.

15. The method of claim 10, and configuring the impact object as one of a cylindrically-shaped bag and a box-shaped bag, and filling the impact object with a material, and positioning the impact surface at opposite sides of the impact object.

16. The method of claim 10, and detecting the striking force, and displaying the striking force exerted by the golfer.

17. The method of claim 10, wherein the adjusting step is performed by manually tensioning a coil spring.

18. The method of claim 10, wherein the adjusting step is performed by selecting an elastic strap from a plurality of elastic straps of different predetermined elasticities.

* * * * *